10/15/85 OP 4,546,590

United States Patent [19]

Finch et al.

[11] Patent Number: 4,546,590

[45] Date of Patent: Oct. 15, 1985

[54] PARTITION WALL SYSTEM AND COMPONENTS THEREFOR

[76] Inventors: Harry E. Finch, 5273 Vista del Sol; Geza J. Szayer, 5335 Canterbury St., both of Cypress, Calif. 90630

[21] Appl. No.: 405,193

[22] Filed: Aug. 4, 1982

[51] Int. Cl.[4] ..... E04D 1/00

[52] U.S. Cl. ..... 52/520; 52/536; 52/574; 52/588

[58] Field of Search ..... 52/241, 520, 588, 574, 52/561, 536, 537, 535, 539, 542, 530

[56] References Cited

U.S. PATENT DOCUMENTS

| | | | |
|---|---|---|---|
| 1,816,556 | 7/1931 | White | 52/539 |
| 1,859,667 | 5/1932 | Gruner | 52/539 |
| 1,913,342 | 6/1933 | Schaffert | 52/588 |
| 1,959,135 | 5/1934 | Miller | 52/241 |
| 1,988,201 | 1/1935 | Hall | 52/588 |
| 2,007,354 | 7/1935 | Vass | 52/588 |
| 2,028,253 | 1/1936 | Spafford | 52/406 |
| 3,055,460 | 9/1962 | Maroney | 52/241 |
| 3,128,851 | 4/1964 | Deridder | 52/588 |
| 3,197,933 | 8/1965 | Burns | 52/542 |
| 3,208,189 | 9/1965 | Hickman | 52/537 |
| 3,394,524 | 7/1968 | Howarth | 52/588 |
| 3,402,526 | 9/1968 | Baxter | 52/536 |
| 3,524,292 | 8/1970 | Bottom | 52/536 |
| 3,660,482 | 5/1972 | Elizalde | 52/537 |
| 3,733,767 | 5/1973 | Craik | 52/588 |
| 3,759,007 | 9/1973 | Thiele | 52/537 X |
| 3,886,705 | 6/1975 | Corland | 52/536 X |
| 3,959,942 | 6/1976 | Merson | 52/537 X |
| 4,078,347 | 5/1976 | Eastman | 52/588 X |
| 4,102,105 | 7/1978 | Taylor | 52/520 |

FOREIGN PATENT DOCUMENTS

| | | | |
|---|---|---|---|
| 574754 | 4/1959 | Canada | 52/239 |
| 2418009 | 10/1974 | Fed. Rep. of Germany | 52/588 |
| 2825118 | 2/1979 | Fed. Rep. of Germany | 52/539 |

*Primary Examiner*—John E. Murtagh
*Assistant Examiner*—Kathryn L. Ford
*Attorney, Agent, or Firm*—Henry M. Bissell

[57] ABSTRACT

An inexpensive, modular, partition system is provided by panels which include a generally rectangular body and connector members on opposed sides of the body and integral therewith. Each connector member includes female and male elements joined together by a stop element which is generally perpendicular to the body. The panels may be connected to one another to form a wall by either an abutting type or overlapping type connection. In the abutting type connection, one connector member of one panel interlocks with a connector member of the other panel and the female and male elements come into mating engagement with each other, with the stop elements of each member abutting each other. In the overlapping type connection, the ends of adjacent panels overlap each other and the male elements of each connector member are secured to the body of an opposing panel. Not only may two panels be joined together, but three or four panels may be connected to form a common junction, for example, at the corners of a storage unit formed by the panels. The mating configuration of the connecting end portions advantageously permits joining of adjacent panels with varying degrees of overlap corresponding to the space in which the panels are to be mounted, thus eliminating the need to cut a panel to fit a limited space.

23 Claims, 13 Drawing Figures

PARTITION WALL SYSTEM AND COMPONENTS THEREFOR

BACKGROUND OF THE INVENTION

1. Field of the Invention

This invention relates to modular partition panels and, more particularly, to modular panels which are made from metal sheets having opposed end portions folded inwardly into uniquely configured connector members.

2. Background Discussion

Self service warehouses (so-called "Ministorage" warehouses) have a number of individual storage units in which the users store property. The structure of these warehouses varies substantially: for example, the floors may be concrete or of wood; ceiling height may be 8 ft., 10 ft., 12 ft., etc.; available floor space and geometry may be regular, irregular, small, large, etc. Each customer also requires a storage unit of a particular size to meet his or her individual requirements. Ideally the storage units would be modular so that as customer requirements change, old storage units could be disassembled and new ones erected to satisfy the present customer requirements. Such storage units should be safe, secure, inexpensive to purchase, and easy to install and disassemble.

SUMMARY OF THE INVENTION

The present invention provides an inexpensive, modular partition system of panels that are strong, durable, and easy to connect together, or disassemble, and that provide a wide range of storage unit sizes. Panels are ordered from the factory to meet the height specifications for any given installation. These panels are formed in accordance with the invention to develop particular edge configurations which facilitate the joining together of adjacent panels in assembling the partition system of the invention. As will be more fully appreciated upon reading the complete specification, no on-site cutting of the panel is required because any two panels may be joined together by either an overlapping type connection or an abutting type connection. No special training is necessary to install or disassemble the panels. The storage units made from these panels are both safe and secure.

The panels are preferably made from metal sheets such as galvanized steel with corrugated ribs in the sheets that strengthen the panel. The rough edges of the metal sheet could be a hazard since, if contacted, they could damage property such as upholstered furniture being stored or could injure the user. Opposed end portions of the metal sheet including these rough edges are folded inwardly to provide the unique connector members. Each connector member has three generally flat, rectangular segments. The first segment extends inwardly toward the center line of the sheet and is generally parallel to the back of the sheet and spaced therefrom a distance which is about equal to or slightly greater than the thickness of the sheet. The space between the first segment and the back of the sheet provides a female element in the connector member. The second segment is integral with the first segment along a common line which is generally parallel to the center line of the sheet. This second segment extends outwardly from the first segment, away from the sheet and generally perpendicular to the sheet. This second segment provides a stop element in the connector member.

The third segment is integral with the second segment along a common line which is generally parallel to the center line of the sheet and spaced apart from the line along which the first and second segments are joined together. The third segment extends inwardly toward the center line of the sheet and is generally parallel to the back of the sheet. This third segment provides a male element in the connector member having a leading edge which is one of the rough edges of the sheet. The first and third segments are of about equal width, generally having a width ranging between about $\frac{1}{4}$ and about $\frac{3}{4}$ inches. The second segment is wider than the first and third segments. Its width ranges between about 1.0 and about $1\frac{7}{8}$ inches. The length of each segment is equal to that of the sheet.

The connector members are the key to the partition system and provide the main advantages of this invention, one such advantage being that the rough edges of the sheet are covered when two panels are connected together to form a wall of the storage unit. In the abutting type connection, one male element matingly engages a female element in another connector member, thus enclosing the rough edge within the female element. In the overlapping type connection, an enclosure is formed by overlapping portions of the panels and other rough edges are disposed within this enclosure. Another advantage of the present invention is that the pointed tips of the screws or other means used to connect the panels together, which would normally protrude from the wall of the storage unit on one side or the other, are hidden, at least partially, by the connector member. Other advantages of the present invention are that the panels are readily manufactured, and provide a very versatile partition system for making storage units of different sizes which are safe, secure, and inexpensive to purchase, install, and disassemble.

BRIEF DESCRIPTION OF THE DRAWING

A better understanding of the present invention may be had from a consideration of the following detailed description, taken in conjunction with the accompanying drawing in which.

DESCRIPTION OF THE PREFERRED EMBODIMENTS

Figure 1:
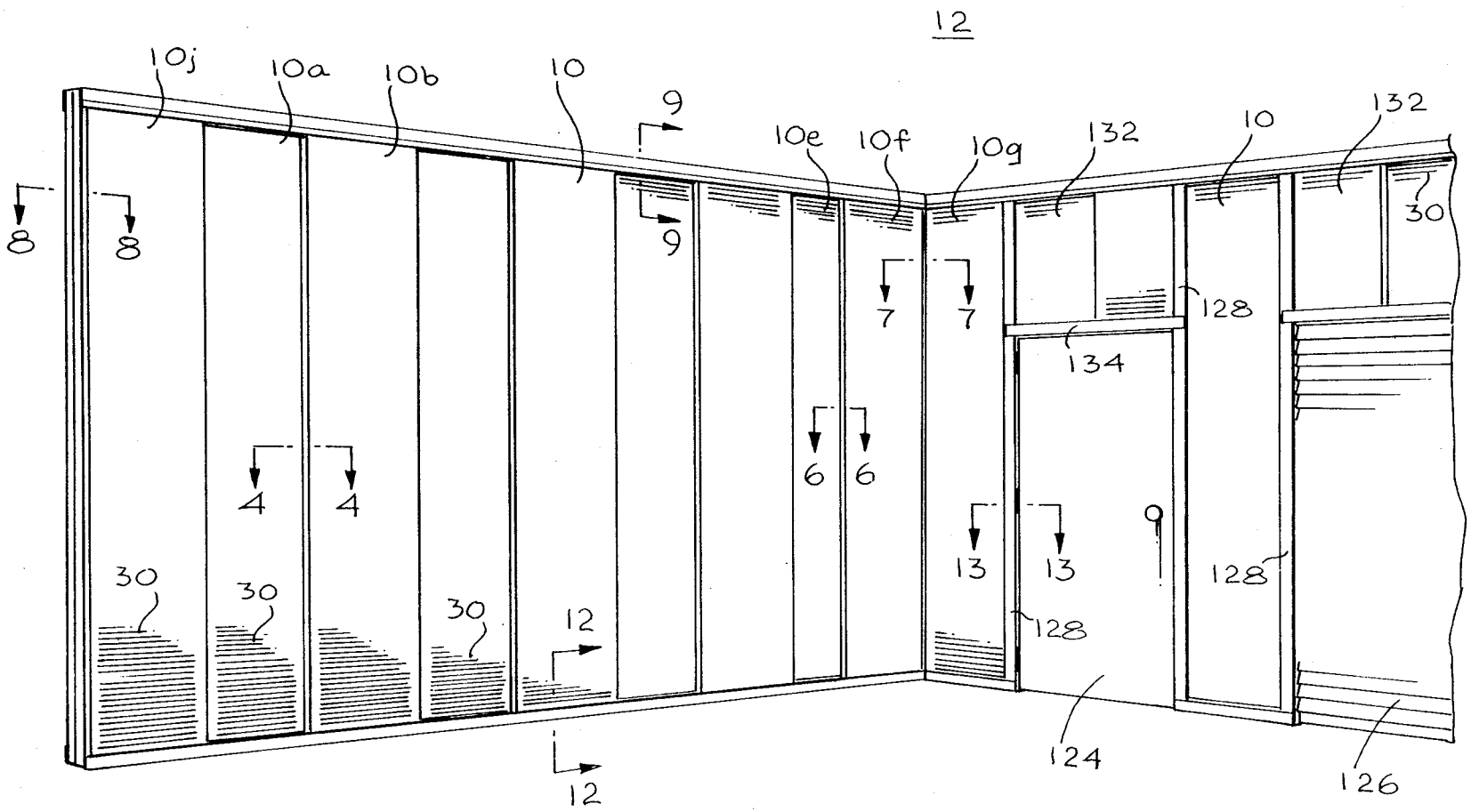
FIG. 1 is a perspective view of two sides of a storage unit made from the panels of this invention.

FIG. 1 shows several panels 10 of this invention connected together to form two sides of a storage unit 12. These panels 10, referred to as standard panels 10, have nominal dimensions of 8 ft.×1½ ft., with novel connector members 14 (FIG. 3) along opposed sides of the panels which extend outwardly from 1 to 2 inches, preferably about 1½ inches, from the back of the body 16 of the panel.

Figure 2:
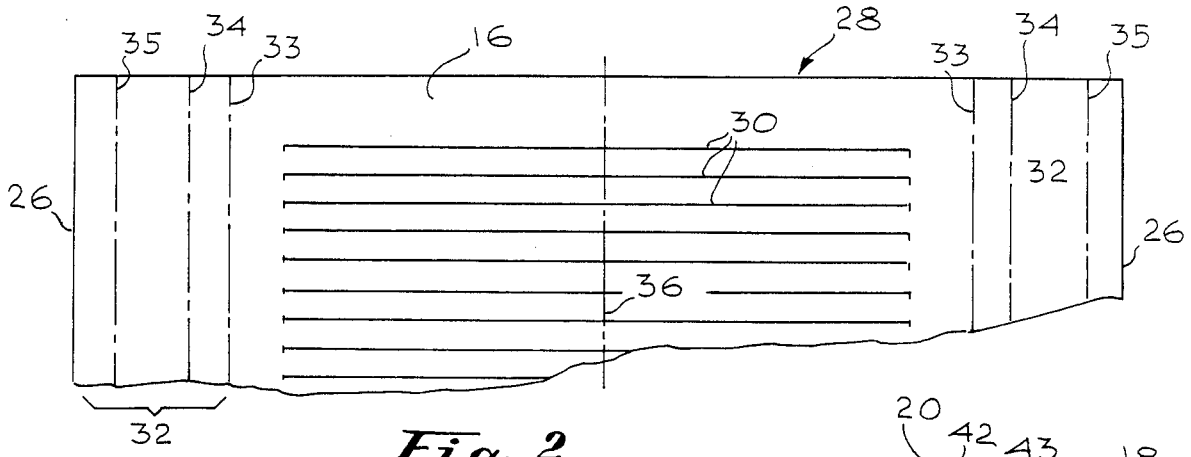
FIG. 2 is a plan view of the corrugated metal sheet from which a panel of this invention is made.
Figure 3:
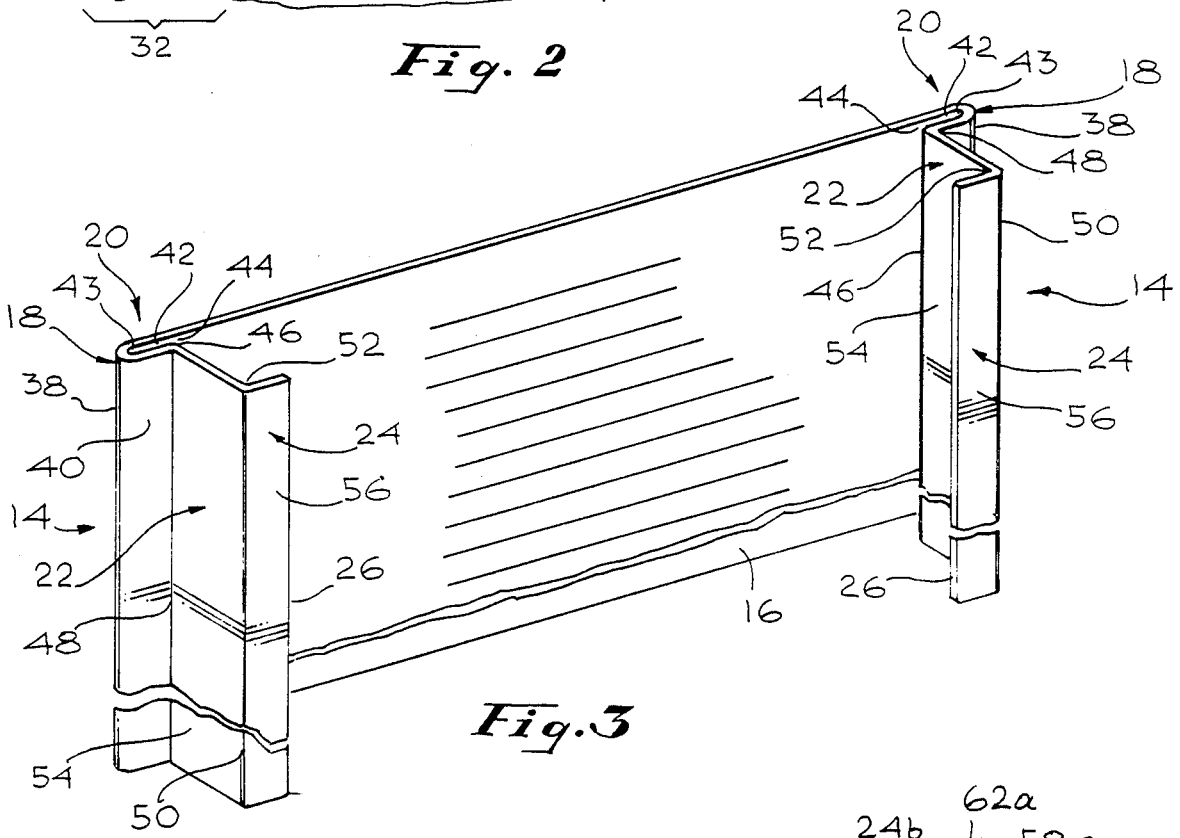
FIG. 3 is a perspective view of one of the panels of this invention.
Figure 6:
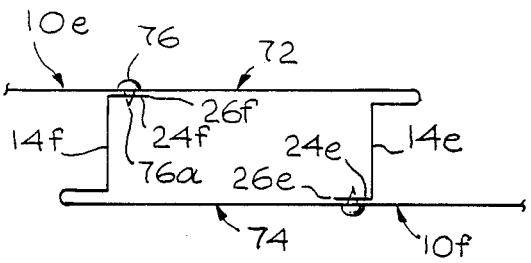
FIG. 6 is a cross-sectional view taken along line 6—6 of FIG. 1.

As illustrated in FIG. 3, each connector member 14 has a lip 18, a female element 20 in the lip 18, a stop element 22, and a male element 24. The lip 18, stop element 22, and male element 24 are integral with each other. The leading end 26 of the male element is the rough edge of the sheet material 28 (FIG. 2) from which the panel is made. As will be apparent from the following discussion, this rough edge 26 is not exposed when panels are connected to form a wall using either an abutting type connection (FIG. 4) or an overlapping type connection (FIG. 6). As shown in FIG. 2, each of the panels is made from a generally rectangular sheet 28 of metal such as steel having a thickness ranging between about 0.016 and about 0.030 inch. Generally, this sheet 28 is between about one and about 2½ feet wide and between about 8 and about 12 feet long, with the length depending on the size of the storage units being constructed. The sheet is corrugated to provide ribs 30 in the body of the panel which are generally at right angles to the edges 26 of the sheet. Each connector member is formed from an end portion 32 of the sheet by folding this end portion about three spaced-apart lines 33, 34, and 35 which are parallel to each other and to the center line 36 of the sheet. This end portion 32 will usually be along the longer dimension of the sheet.

In one particular embodiment, the first fold line 33 is 1½ inches from the edge 26 of the sheet. The second line 34 is 1¼ inches from the edge 26 of the sheet. Thus distance between the first and second lines 33 and 34 is ¼ inch. The third line 35 is also ¼ inch from the edge 26. The distance between the second and third lines 34 and 35 is about one inch.

The end portion 32 of the sheet is folded using conventional equipment. Specifically, the lip 18 is formed by inwardly folding the end portion 32 of the sheet (FIG. 2) about the first line 33 towards the center line 36 through a bend of about 180° and outwardly folding the end portion about the second line 34 away from the body 16 of the panel through a bend of about 90°. This lip 18 has a smooth, rounded edge 38 which is as long (high) as the body of the panel and a generally flat segment 40 between this edge 38 and the bend about the second line 34. The flat segment 40 is as long as the body of the panel and has a width of about ¼ inch, the distance between lines 33 and 34. It is also generally parallel to the body 16 of the panel and is spaced from the body a distance which is about equal to or slightly greater than the thickness of the sheet 28. This spacing provides a cavity 42 which is part of the female element 20. This cavity 42 terminates at one end at a bight 43 opposite the edge 38, and it terminates at its other end at an opening 44 which runs along the length of the body of the panel. This opening 44 is adapted to receive a male member of another panel. The top and bottom of the cavity 42 are open.

The stop element 22 is formed by inwardly folding the end portion 32 of the sheet about the third line 35 towards the center line 36 through a bend of about 90°. This stop element 22 has one smooth, rounded edge 46 at the opening 44 in the cavity. This edge 46 has a length which is equal to the length of the body of the panel and a bight 48 opposite this edge on the opposed side of the sheet. Another smooth, rounded edge 50 is provided upon folding the end portion 32 about the line 35. This edge 50 also has a length equal to the length of the body of the panel and a bight 52 opposite it on the opposed side of the sheet. The stop element 22 also has a gnerally flat, rectangular segment 54 between the lines 34 and 35. The length of this segment is equal to the length of the body of the panel and its width is about one inch, the distance between lines 34 and 35. It is generally perpendicular to the body of the panel.

The male element 24 is formed when the end portion 32 of the sheet is bent about the third line 35. It also has a generally flat, rectangular segment 56 which has a length equal to the length of the body of the panel and a width equal to about ¼ inch, the distance between line 35 and the rough edge 26 of the sheet. As mentioned above, this rough edge 26 of the sheet constitutes the leading edge of the male element which is inserted into the cavity of another connector member.

Figure 4:
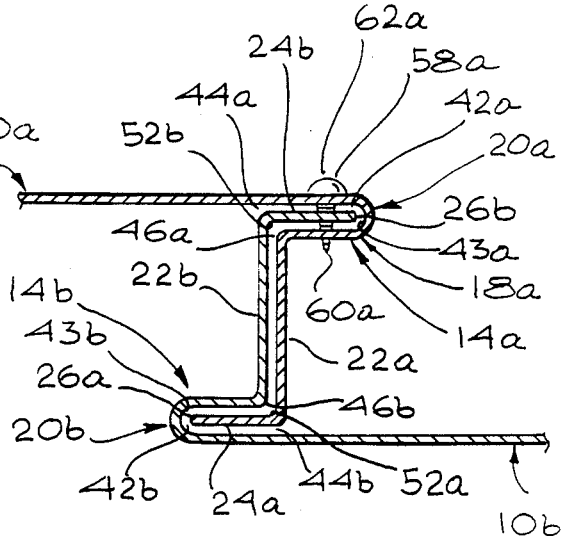
FIG. 4 is an enlarged cross-sectional view taken along line 4—4 of FIG. 1.

As best illustrated in FIG. 4, two different panels **10*a* and 10*b* having essentially identical connector members 14*a* and 14*b* are joined together by simply bringing the female and male elements of the connector members 14 into mating engagement with each other. This is referred to as the abutting type connection. As viewed in FIG. 4, the male element 24*b* of the right-hand panel 10*b* is inserted into the opening 44*a* in the cavity 42*a* of the female element 20*a* of the left-hand panel 10*a* and the male element 24*a* of the left-hand panel 10*a* is inserted into the opening 44*b* in the cavity 42*b* of the female element 20*b* of the right-hand panel 10*b*. The stop elements 22*a* and 22*b* abut each other, with the respective edges 46*a* and 46*b* of the stop elements nestled, respectively, in the bights 52*b* and 52*a*. The rough ends 26*a* and 26*b* are received, respectively, within the cavities 42*b* and 42*a* and are just about touching, respectively, the bights 43*b* and 43*a*. Thus, the ends 26*a* and 26*b*** are covered so that they cannot cause damage or injury.

Preferably, the panels **10*a* and 10*b* are fastened to each other by such conventional means as self-drilling screws 58*a*. These screws are provided with tapered flutes (not shown) at their tips 60*a* which drill a hole into the metal as the screw is being forced against the surface of the metal by a power drill. The screws are inserted at several spaced-apart points along the length and on the front side of the lip of one of the connector members, for example, lip 18*a*. Upon insertion of the screw 58, the tip 60 of the screw passes through the front side of the lip 18*a* into the cavity 42*a*, through the male element 24*b* of the connector member 14*b*, and then through the underside of the lip 18*a*, protruding therefrom. The head 62*a* of the screw 58*a* abuts the front side of the lip 18*a*. The protruding tip 60*a* of the screw is hidden from view by the lip 18*a* and does not extend outwardly from the face of the panel. This reduces substantially the risk of anyone injuring themselves or damaging their clothing or items stored within the enclosure by snagging them against the tip 18***a* of the screw.

Figure 7:
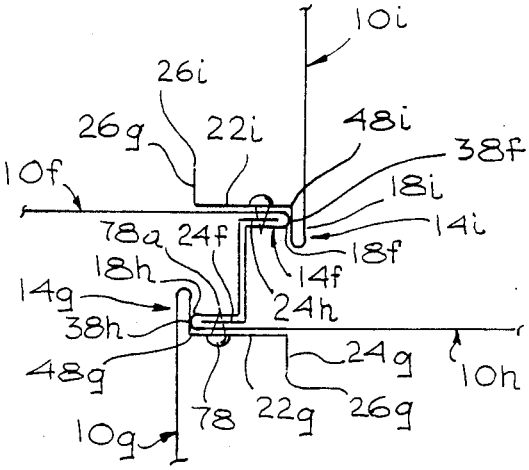
FIG. 7 is a cross-sectional view taken along line 7—7 of FIG. 1.

By virtue of this manner of fastening panels together, as particularly shown in FIGS. 4 and 7, for example, the pointed ends of the self-drilling screws 58 are behind the lip of the junction edge or, as in FIG. 6, within the box formed by the junction. Thus, they are out of the way and unlikely to cause any damage to goods stored in the storage unit or to injure anyone, since they are unlikely to be contacted. The rounded heads of the self-drilling screws are along the exposed surface of the joined-panel wall. This allows for easy disassembly of a wall when it is desired to move a wall or reconstruct a storage unit. However, it will be noted that the screws enter the panel junction from two opposite sides. Thus, a person having access to only one side of a wall (e.g., the user of a single storage unit) will not be able to disassemble a wall and thereby cannot gain unauthorized access to an adjacent storage unit.

Figure 5:
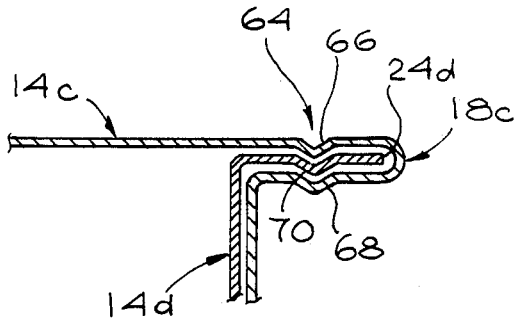
FIG. 5 is an enlarged fragmentary view, similar to FIG. 4, showing an alternate way of fastening together the panels of this invention.

An alternate way of fastening connector members 14*c* and 14*d* together is shown in FIG. 5. Here a dimple 64 is formed in the lip 18*c* of the connector member 14*c* using a conventional sheet metal punch having an oversized female die. The punch includes a male member which is manually movable into and out of the female die. With the male member withdrawn from the female die, the lip 18*c*, retaining the male element 24*d* of the connector member 14*d*, is placed between the male member and the female die of the punch. The male member is then depressed, forcing two opposed pieces 66 and 68 from the front side and back side of the lip 18*c* and one piece 70 from the male element 24*d* into the die. This forms the dimple 64 which consists of three hollow cones formed, respectively, from the pieces 66, 70, and 68. These cones 66, 70 and 68 are tightly jammed together so that the two connector members are secured to each other. A plurality of these dimples 64 can be readily formed in this manner along one or both junction edges of a pair of panels being joined, thus facilitating the assembly and construction of a panel wall.

As shown in FIG. 6, whenever the dimensions of the storage unit 12 require, two panels may be joined together to form a sidewall using an overlapping or telescoping type connection rather than the abutting type connection shown in FIG. 4. Thus, any size storage unit wall may be fashioned using standard panels without the need for cutting panels on site. Typically, the last panel to be joined in the wall being constructed is joined in overlapping fashion to accommodate the remaining dimensional space to the next adjacent intersecting wall.

As illustrated in FIG. 1, the respective connector members of the panels 14*e* and 14*f* of the panels 10*e* and 10*f* are attached employing this overlap connection. The desired width is obtained by moving these two standard panels relative to each other sideways. The male elements 24*e* and 24*f* of each of the connector members are parallel to the overlapping sections 72 and 74 of the body of the panels. With the male elements of the two connector members so positioned, one of them, for example 14*f*, is simply fastened to the back of the body of the other panel by means of self-drilling screws 76. Each screw is inserted through the face of the panel 10*e* into and through the male element 24*f* of the opposite panel 10*f*. The rough edges 26*e* and 26*f* of the male elements 24*e* and 24*f*, respectively, and the tips 76*a* of the screws extending through the male members are hidden in an enclosure formed by the opposed connector members 14*e* and 14*f* and the overlapping sections 72 and 74 of the panels. Therefore, any danger of damage from contact with the rough edges or screw tips is avoided.

In accordance with an important feature of this invention, not only two, but three or four panels may be joined together along a common junction. Thus, for example, four different storage units would have a common point of connection. This is illustrated in FIG. 7 where the panels 10*f*, 10*g*, 10*h* and 10*i* are shown joined together. Two of the panels 10*f* and 10*h* are connected as illustrated in FIG. 3 except that screws are not immediately inserted into the lips 18*f* and 18*h* of these panels until the other two panels 10*g* and 10*i* have been placed in position. The panel 10*g* is placed against the face of the panel 10*h* so that its lip 18*g* overlaps and is at a right angle to the lip 18*h* of the panel 10*h* and the stop element 22*g* abuts the face of this panel 10*h*, with the edge 38*h* of the lip 18*h* nestled into the bight 48*g* in the connector member 14*g*. In a similar manner, the panel 10*i* is placed against the face of the panel 10*g* so that its connector member's lip 18*i* overlaps and is at a right angle to the lip 18*f* of the connector member of panel 10*f* and stop member 22*i* abuts the face of this panel 10*f*, with the edge 38*f* of the lip 14*f* being nestled into the bight 48*i* of the connector member 14*i*. Panels 10*g* and 10*i* are generally parallel to each other; however they are slightly offset with respect to each other a distance corresponding to the width of one lip, which is about three times the thickness of the sheet.

The panel 10*g* is fastened to the panels 10*g* and 10*h* by inserting several self-drilling screws 78 through the stop element 22*g* into the front side of the lip 18*h*, through the male element 24*f* of the connector member of panel 10*g*, and out the underside of lip 18*h*. The lip 18*g* forms an enclosure which partially hides the protruding tip of the screw 78*a*. This provides both esthetic and safety advantages. In like fashion several self-drilling screws are inserted through the stop element 22*i* through the front side of the lip 18*f* into and through the male element 24*h*, and out the underside of the lip 18*f*, securing together the panels 10*i*, 10*g* and 10*h*. The rough edges 26*i* and 26*g*, respectively, of the male elements 24*i* and 24*g* are exposed and, preferably, are covered with tape or other suitable protective means. This will reduce the risk of anyone injuring themselves or damaging their clothing or items stored in the storage unit by contacting these edges.

Figure 8:
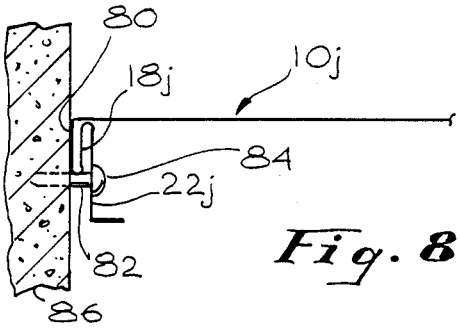
FIG. 8 is a cross-sectional view taken along line 8—8 of FIG. 1.

In accordance with another feature of this invention, as illustrated in FIG. 8, a starter wall panel 10*j* is provided by simply bending its lip 18*j* inwardly toward the stop element 22*j* through a bend of 90° and flattening it. This provides a stop plate 80 which has a step 82 in it equal to three times the thickness of the sheet 28. With the stop plate 80 abutting a wall, screws or ram nails 84 are inserted through the underside of this stop plate into the wall 86 to secure the panel to the wall.

Figure 9:
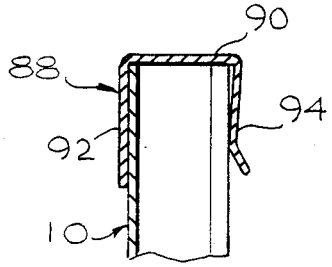
FIG. 9 is a cross-sectional view taken along line 9—9 of FIG. 1 illustrating one type of connection for the tops of the panels.
Figure 10:
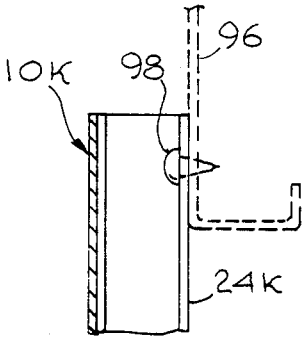
FIG. 10 is a elevational view showing one alternative type of connection for the top of the panels.
Figure 11:
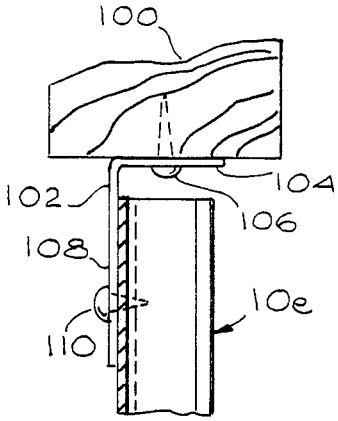
FIG. 11 is an elevational view showing a second alternative type of connection for the tops of the panels.

The panels of this invention are connected at their tops by any one of several conventional means. Three typical connections are illustrated in FIGS. 9 through 11. In FIG. 1 the panels 10 are free standing and a U-shaped bracket 88 (FIG. 9) is placed over the tops of several adjoining panels. This bracket 88 has a generally horizontal piece 90 having at its opposed ends a generally vertical piece 92 which points downwardly and a clip piece 94 which also points downwardly and is biased inwardly. Thus, when the panel 10 is inserted between the pieces 92 and 94, the clip piece presses against the panel to hold the panel secure. In FIG. 10, a panel 10*k* is shown connected to a purlin or beam 96 by inserting a self-drilling screw 98 through the male member **24*k* of the panel into the beam. In FIG. 11, a panel 101 is shown connected to the underside of a beam or joist 100 by means of an L-shaped bracket 102. The foot 104 of the bracket is connected by a conventional wood screw 106 to the joist 100 and the leg 108 of the bracket is secured by self-drilling screws 110 which pass through a hole in the leg and through the face of the panel 101**.

Figure 12:
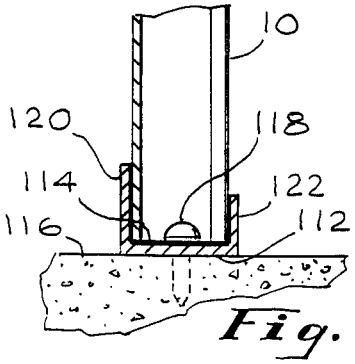
FIG. 12 is a cross-sectional view taken along line 12—12 of FIG. 1.

The bottom of the panel 10 is held in a U-shaped bracket 112 of the type illustrated in FIG. 12. This bracket includes a flat portion 114 which rests against, for example, a concrete floor 116 and a ram nail 118 is inserted through a hole in this flat portion into the floor. One side 120 of the bracket is slightly longer than the other side.

Figure 13:
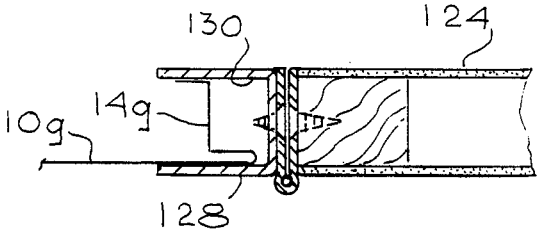
FIG. 13 is a cross-sectional view taken along line 13—13 of FIG. 1.

As shown in FIG. 1, the storage unit 12 may include a hinged door 124 and an overhead roll-up door 126. As illustrated in FIG. 13, conventional U-shaped channel members 128 receive within the channel 130 the connector members, for example the connector member **14*g* of the panel 10*g*. The doors 124 and 126 are secured by conventional means to these U-shaped members 128**.

Transom panels 132 (FIG. 1) are provided which have the same general configuration as standard panels except they are shorter in length than the standard panel. These transom panels have connector members connected together as illustrated in FIG. 4 or FIG. 6. The unattached connector members of the transom panels are received in the channels of the U-shaped brackets 134.

Although there have been described above specific arrangements of modular panels having unique connector members in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed:

1. A plurality of like panels assembled in interlocking relationship to form a partition wall, each panel comprising:

(a) a generally rectangular planar central body, and (b) a pair of selectively shaped connector means offset from the plane of the body and extending in the same direction therefrom along opposite edges of the body and integral therewith, (c) each of said connector means including a female element adjacent an edge of the body and a male element spaced from the female element by a stop element which is generally perpendicular to the body, both the male and female elements facing the respective male and female elements of the other connector means of said panel, (d) the stop element spacing the male element from the female element such that said female and male elements matingly and releasably engage respective male and female elements of a like panel which is inverted relative to the first-mentioned panel and joined thereto with the connector means interlocking, with the stop elements of the adjacent connector means of the two panels abutting each other during such mating engagement;

and further including means for releasably fastening the interlocking connector means together.

2. The panel of claim 1 wherein the male element of each connector means is closer to the center of the body than the female component thereof.

3. The panel of claim 1 wherein the panel is made of metal.

4. The panel of claim 1 wherein the body includes ribs which reinforce the panel.

5. The panel of claim 1 wherein the connector means each have an outwardly projecting lip along the body edge which includes the female element.

6. A plurality of like panels forming a partition wall, each panel comprising:

a generally rectangular, planar, central body, and a pair of connector members extending along opposite edges of the body, offset from the plane of the body on the same side thereof and integral therewith, the two connector members being mirror images of each other and each of said connector members including a lip, a female element, a stop element, and a male element in which (a) the female element comprises a two-sided cavity in the lip which has an opening therein laterally displaced from the side of the body and facing the center line of the body, the cavity sides being spaced apart by the thickness of the sheet metal so as to releasably engage the male element of a like connector member of an adjacent panel in interlocking relationship, (b) the stop element is generally flat, perpendicular to the body, and integral with the lip along a common line that is adjacent the opening in the cavity and is parallel to the center line of the body and (c) the male element is generally flat, parallel to the body, and integral with the stop element along a common line that is spaced from the opening in the cavity and is parallel to the center line of the body, said male element having a free edge which is inserted into the cavity in the lip of the like connector member of an adjoining panel.

7. A plurality of panels assembled in interlocking relationship to form a partition wall, each panel being made from generally rectangular metal sheet material having a thickness ranging between about 0.016 and about 0.030 inch, said sheet material having opposed longitudinal edges which are generally parallel to each other and to the center line of the sheet material, and each panel comprising:

longitudinal connector members on opposed edges which permit two, three, or four panels to be connected together at a common junction, or which permit two panels to be connected to each other by an overlapping type connection or an abutting type connection;

each of said connector members being integral with and formed from the metal sheet material and having (a) a first generally flat, rectangular segment extending inwardly towards the center line, said first segment being generally parallel to the back of the sheet material and spaced therefrom a distance which is equal to or slightly greater than the thickness of the sheet material, said space between the first segment and the back of the sheet material providing a female element in the connector member receiving a male element of an adjacent panel when two panel members are connected together by an overlapping type connection, (b) a second generally flat, rectangular segment integral with the first segment along a common line which is generally parallel to the center line, said second segment extending outwardly from the first segment, away from the back of the sheet material and generally perpendicular to the back of the sheet material, thereby providing a stop element in the connector member, and (c) a third generally flat, rectangular segment integral with the second segment along a common line which is generally parallel to the center line and spaced apart from the line along which the first and second segments are joined together, said third segment extending inwardly toward the center line of the sheet material and being generally parallel to the back of the sheet, thereby providing a male element in the connector member having a leading edge which is one of the longitudinal edges of the sheet material;

the spacing and configuration of the male and female elements being such that said connector member interlocks with a like connector member of an adjacent panel when joined thereto.

8. The panel of claim 7 wherein the first and third segments are of about equal width.

9. The panel of claim 7 wherein the first and third segments have a width ranging between about $\frac{1}{4}$ and about $\frac{3}{4}$ inches.

10. The panel of claim 7 wherein the second segment is wider than the first and third segments.

11. The panel of claim 7 wherein the second segment has a width between about $\frac{7}{8}$ and about $1\frac{7}{8}$ inches.

12. A partition wall system comprising:

a plurality of substantially identical panels, each having opposed vertical edges which are laterally offset in the same direction from the panel;

each panel including a vertical edge portion selectively shaped to form a generally U-shaped portion and a generally L-shaped portion, the U-shaped portion being flattened with the sides of the U-spaced apart by approximately the thickness of the panel material so as to receive, when joined with an adjacent panel, the terminating edge of the L-shaped portion, the other edge of the L-shaped portion extending from and being integrally formed with an adjacent side of the U-shaped portion, the adjacent panels being offset from each other in the lateral direction of the wall by an amount generally equal to the length of one leg of the L-shaped portion; and means for fastening the terminating edge of the L-shaped portion to an adjacent portion of an adjoining panel.

13. The partition wall system of claim 12 wherein the terminating edge of an L-shaped portion is mounted between the sidewalls of the U-shaped portion, and the fastening means secures said terminating edge therein.

14. The system of claim 13 wherein the fastening means comprises a plurality of self-drilling screws extending through the sidewalls of the flattened U-shaped portion and the terminating edge of an adjoining panel inserted therein with the tips of the screws facing away from the exposed surface of the panel wall.

15. The system of claim 14 wherein the panels are assembled with their opposed vertical edges offset laterally in opposite directions from the main portion of the panel and the self-drilling screws are alternatively inserted from opposite faces of the wall in order to preclude disassembly of a wall from only one side of the wall.

16. The system of claim 12 for assembly and erection in an existing building structure having at least one wall to which the panel wall may be attached, wherein one panel at the end of the panel wall has the flattened U-shaped portion bent through approximately 90° to extend along the adjacent section of the L-shaped portion to form a surface for attachment to the building wall.

17. The system of claim 16 further including a plurality of channel members for reinforcing the panels joined together in the panel wall.

18. The system of claim 17 further including means for attaching selected ones of said channel members to structural members of said building.

19. The system of claim 12 wherein at least two adjacent panels are telescoped to overlap relative to each other to accommodate a limited dimension of the panel wall such that adjacent terminating edges of the two panels are spaced apart from each other.

20. The system of claim 13 wherein the fastening means comprise a plurality of dimpled deformations of the U-shaped channel portions with terminating edges of adjacent panels inserted therein, said deformations being developed after the panels are joined together.

21. The system of claim 12 further including means for mounting a conventional door structure to the edges of panels within a panel wall.

22. The system of claim 12 further including means for attaching the edge of a panel at right angles to another panel by joining the L-shaped portion of one panel to the U-shaped portion of the other.

23. A panel made from metal sheet material for use in the partition wall system of claim 12 comprising:

a central, generally planar, panel portion; and a pair of opposed offset edge portions which are laterally offset in the same direction from the panel portion;

each opposed edge portion being selectively shaped to form a generally U-shaped portion and a generally L-shaped portion, the U-shaped portion being flattened with the sides of the U spaced apart by approximately the thickness of the panel sheet material so as to receive, when joined with an adjacent panel, the terminating edge of the L-shaped portion, the other edge of the L-shaped portion extending from and being integrally formed with an adjacent side of the U-shaped portion.

* * * * *